US009836003B2

(12) United States Patent
Maeda et al.

(10) Patent No.: US 9,836,003 B2
(45) Date of Patent: Dec. 5, 2017

(54) TRANSPORT DEVICE

(71) Applicant: FUJI XEROX CO., LTD., Tokyo (JP)

(72) Inventors: Shouichi Maeda, Kanagawa (JP); Takashi Abe, Kanagawa (JP); Takayuki Yazawa, Kanagawa (JP); Shinji Yaginuma, Kanagawa (JP); Junichi Asaoka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/207,579

(22) Filed: Jul. 12, 2016

(65) Prior Publication Data

US 2017/0277103 A1 Sep. 28, 2017

(30) Foreign Application Priority Data

Mar. 22, 2016 (JP) ..... 2016-056545
Mar. 22, 2016 (JP) ..... 2016-056546

(51) Int. Cl.
*G03G 15/00* (2006.01)
*B65H 1/04* (2006.01)
*B65H 9/02* (2006.01)

(52) U.S. Cl.
CPC ..... *G03G 15/6529* (2013.01); *B65H 1/04* (2013.01); *B65H 9/02* (2013.01)

(58) Field of Classification Search
CPC ... B65H 1/04; B65H 1/08; B65H 1/14; B65H 2405/32; B65H 2405/324; B65H 9/02; G03G 15/6529
USPC ..... 271/162, 164
See application file for complete search history.

(56) References Cited

U.S. PATENT DOCUMENTS 4,231,566 A * 11/1980 Suzuki ..... B65H 1/04 221/231
5,135,214 A * 8/1992 Sugimoto ..... B65H 1/04 271/164
5,149,079 A * 9/1992 Iwamoto ..... B65H 1/04 271/127
5,150,890 A * 9/1992 Kunikawa ..... B65H 3/44 271/127
5,217,217 A * 6/1993 Matsumoto ..... B65H 1/04 271/162
2003/0075857 A1* 4/2003 Matsuki ..... B65H 1/04 271/162
2007/0045946 A1* 3/2007 Nakashima ..... B65H 1/26 271/274

(Continued)

FOREIGN PATENT DOCUMENTS

JP 2015-199556 A 11/2015

*Primary Examiner* — David H Bollinger
(74) *Attorney, Agent, or Firm* — Sughrue Mion, PLLC

(57) ABSTRACT

A transport device includes a body unit, an accommodating unit that accommodates a recording medium and is mounted to be reciprocal with respect to the body unit, a pair of guide members that come in contact with end portions, in a width direction, of the recording medium to position the recording medium, the width direction intersecting with a transport direction of the recording medium, a first rail that is attached to the accommodating unit and guides reciprocation of the accommodating unit, and a second rail that is attached to the body unit to be movable in a direction, which intersects with a reciprocation direction of the accommodating unit, the second rail being assembled to the body unit to be slidable with respect to the first rail.

16 Claims, 7 Drawing Sheets

(56) References Cited

U.S. PATENT DOCUMENTS

| | | | | |
|---|---|---|---|---|
| 2009/0256303 | A1* | 10/2009 | Adachi | B65H 1/04 271/9.01 |
| 2013/0062827 | A1* | 3/2013 | Fuda | B65H 1/04 271/147 |
| 2013/0334766 | A1* | 12/2013 | Okamoto | A47B 88/0466 271/145 |
| 2014/0021680 | A1* | 1/2014 | Hamasaki | B65H 1/00 271/147 |
| 2014/0055016 | A1* | 2/2014 | Nishikawa | H05K 5/0247 312/223.6 |
| 2014/0203496 | A1* | 7/2014 | Hamasaki | B65H 7/06 271/18 |
| 2014/0217669 | A1* | 8/2014 | Aoji | B65H 31/22 271/297 |
| 2015/0115523 | A1* | 4/2015 | Yamaguchi | B65H 7/02 271/162 |
| 2015/0284195 | A1 | 10/2015 | Kushida et al. | |

* cited by examiner

TRANSPORT DEVICE

CROSS-REFERENCE TO RELATED APPLICATIONS

This application is based on and claims priority under 35 USC 119 from Japanese Patent Applications No. 2016-056545 filed Mar. 22, 2016 and No. 2016-056546 filed Mar. 22, 2016.

BACKGROUND

Technical Field

The present invention relates to a transport device.

SUMMARY

According to one exemplary embodiment, a transport device includes a body unit, an accommodating unit that accommodates a recording medium and is mounted to be reciprocal with respect to the body unit, a pair of guide members that come in contact with end portions, in a width direction, of the recording medium to position the recording medium, the width direction intersecting with a transport direction of the recording medium, a first rail that is attached to the accommodating unit and guides reciprocation of the accommodating unit, and a second rail that is attached to the body unit to be movable in a direction, which intersects with a reciprocation direction of the accommodating unit, the second rail being assembled to the body unit to be slidable with respect to the first rail.

BRIEF DESCRIPTION OF THE DRAWINGS

Exemplary embodiment(s) of the present invention will be described in detailed based on the following figures, wherein.

DETAILED DESCRIPTION

Figure 1:
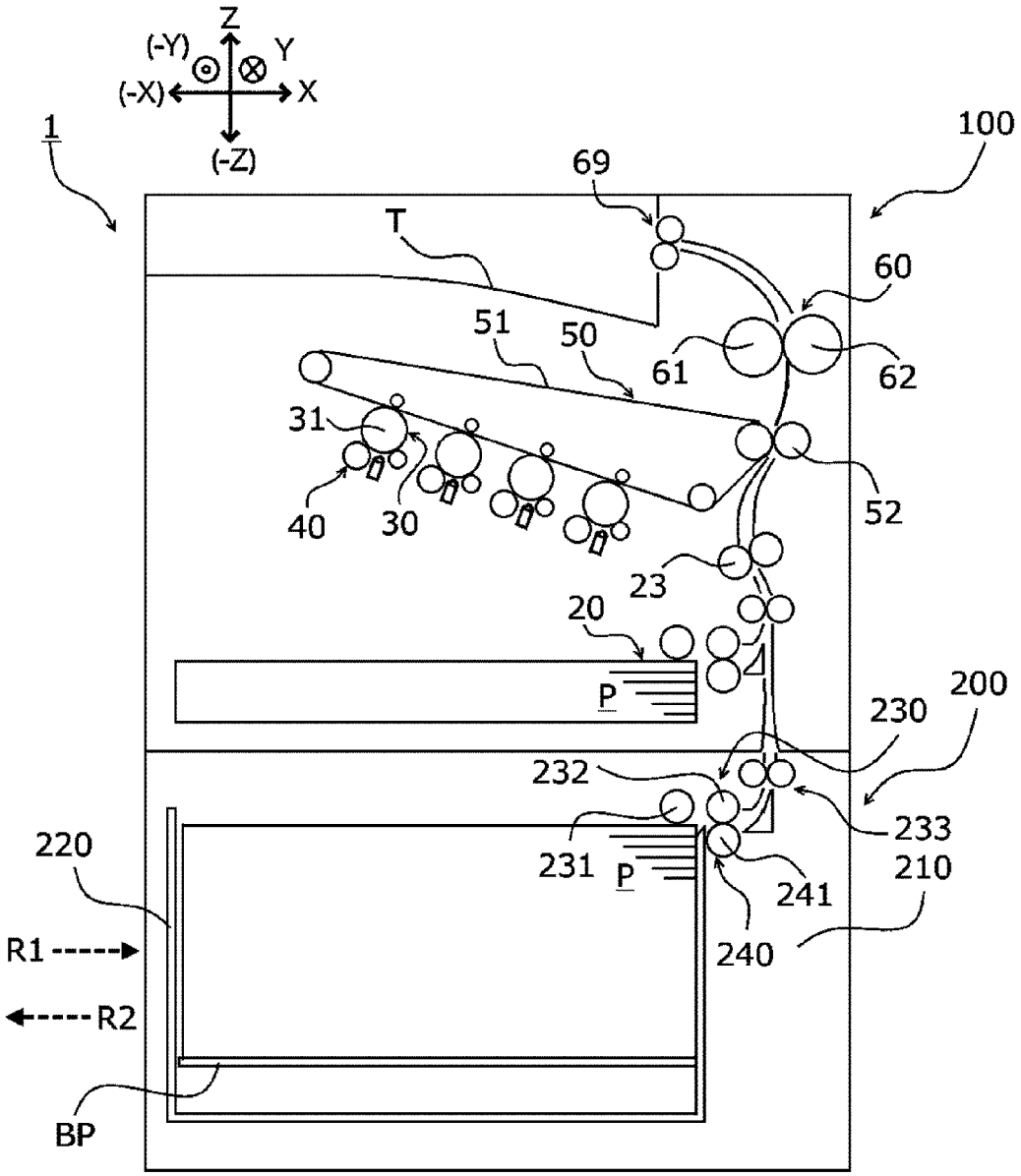
FIG. 1 is a sectional schematic diagram illustrating an internal configuration of an image forming system.

Hereinafter, the present invention will be described in more detail in connection with exemplary embodiments and specific examples with reference to drawings, but is not limited to the exemplary embodiments and specific examples.

Further, in the following descriptions made with reference to the drawings, it should be noted that the drawings are schematic and the ratios of respective dimensions are different from those of actual ones. For easy understanding, illustrations of members other than those necessary for the descriptions are properly omitted.

In order to facilitate the understanding of the following descriptions, it is assumed that, in the drawings, the front-rear direction is the X-axis direction, the left-right direction is the Y-axis direction, and the up-down direction is the Z-axis direction.

(1) Overall Configuration and Operation of Image Forming System

FIG. 1 is a schematic configuration diagram illustrating an image forming system 1 to which a transport device 200 according to the present exemplary embodiment is applied. The image forming system 1 illustrated in FIG. 1 includes an image forming apparatus 100, such as a printer or a copier, which forms an image by an electrophotographic system, and the transport device 200 configured to transport a sheet P as a recording medium on which a toner image is formed, to the image forming apparatus 100.

Hereinafter, the overall configuration and operation of the image forming system 1 will be described with reference to the drawings.

(1.1) Overall Configuration and Operation of Image Forming Apparatus

The image forming apparatus 100 is configured to include a controller 10, a sheet feeding device 20, photoconductor units 30, developing devices 40, a transfer device 50, and a fixing device 60. The transport device 200 is disposed below the image forming apparatus 100 (−Z direction), and transports a sheet P, on which an image is to be recorded, to the image forming apparatus 100.

At the bottom portion of the image forming apparatus 100, the sheet feeding device 20 on which sheets P as recording mediums are stacked is provided. Sheets P, of which the position in the width direction is determined on a regulation plate (not illustrated), are pulled out one by one from the top by a sheet pull-out unit 22 forward (−X direction) and transported to a nip portion of a resist roller pair 23.

The photoconductor units 30 include photoconductor drums 31 which are provided, respectively, in parallel above the sheet feeding device 20 (Z direction), and are rotationally driven. On each of the photoconductor drums 31, a toner image of yellow (Y), magenta (M), cyan (C), or black (K) is formed by each of the developing devices 40.

The toner images of respective colors formed, respectively, on the photoconductor drums 31 of the photoconductor units 30 are sequentially electrostatically transferred (primarily transferred) on an intermediate transfer belt 51 of the transfer device 50, and a superimposed toner image obtained by superimposing the toners of respective colors is formed. The superimposed toner image on the intermediate transfer belt 51 is fed from the resist roller pair 23 and collectively transferred to a sheet P guided by a transport guide by a secondary transfer roller 52.

The sheet P on which the toner images are collectively transferred in the transfer device 50 is transported to the fixing device 60 in a state where the toner images are unfixed, and the toner images are fixed through an action of pressing and heating by a pair of heating and pressure modules 61 and 62.

The sheet P formed with the fixed toner images is guided by the transport guide, and discharged to and accommodated in an exit tray unit T formed on the top surface of the image forming apparatus 100 (Z direction) from a pair of exit rollers 69.

(1.2) Overall Configuration and Operation of Transport Device

The transport device 200 includes a body unit 210 and an accommodating unit 220. The body unit 210 is configured to be detachable with respect to the image forming apparatus 100, and has a transport path of a sheet P to be connected to a sheet transport path included in the image forming apparatus 100.

The accommodating unit 220 is configured to accommodate a number of sheets P, and mounted to be reciprocal with respect to the body unit 210. The accommodating unit 220 includes a sheet stacking plate BP on which sheets P are stacked, and moves the sheet stacking plate BP according to the remaining amount of the sheets P.

The accommodating unit 220 is mounted by being moved in the direction of the arrow R1 in FIG. 1 (hereinafter, also referred to as a "mounting direction"), and is detached by being moved in the direction of the arrow R2 (hereinafter, also referred to as a "detaching direction"), that is, its mounted state is released.

A sheet feeding unit 230 is provided in the body unit 210, and a supply unit 240 is attached to the accommodating unit 220. In a state where the accommodating unit 220 is mounted in the body unit 210, a feed roll 232 as a transport member of the sheet feeding unit 230 and a retard roll 241 as a separation member of the supply unit 240 are abutted on each other so as to separate sheets P which are fed from a nudger roll 231 one by one and transport the separated sheets P to the image forming apparatus 100.

(2) Transport Device

Figure 2A:
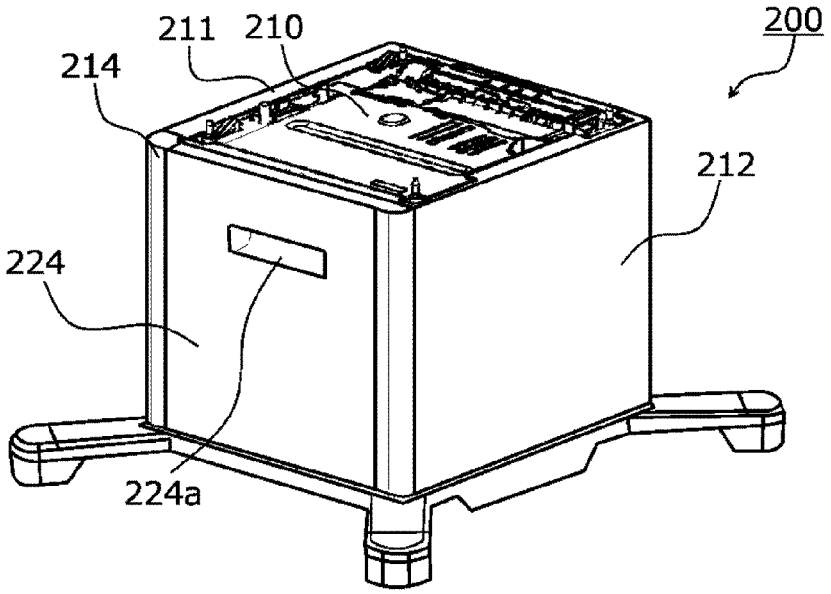
FIG. 2A is a perspective view illustrating the whole of a transport device.
Figure 2B:
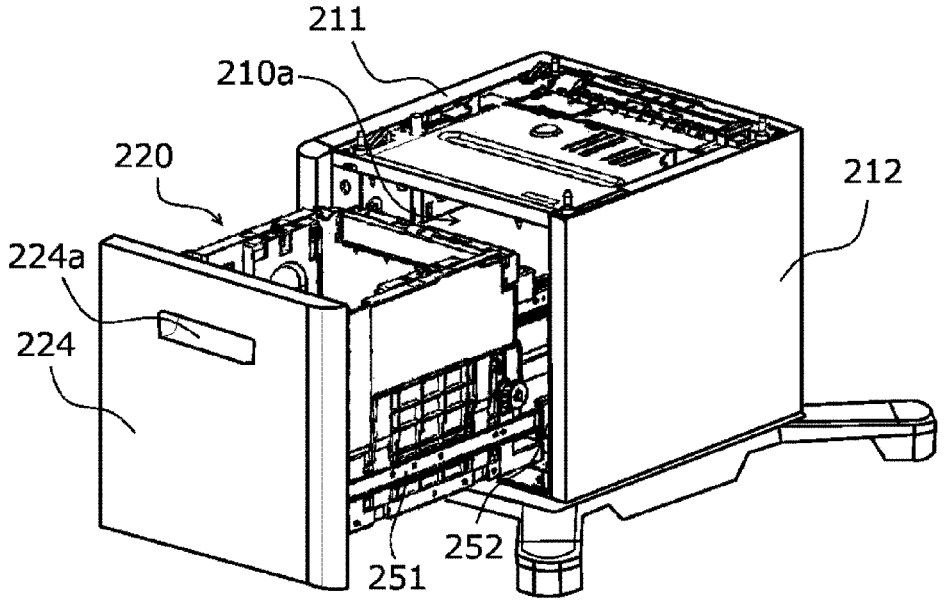
FIG. 2B is a perspective view illustrating a state where an accommodating unit is pulled out.
Figure 3:
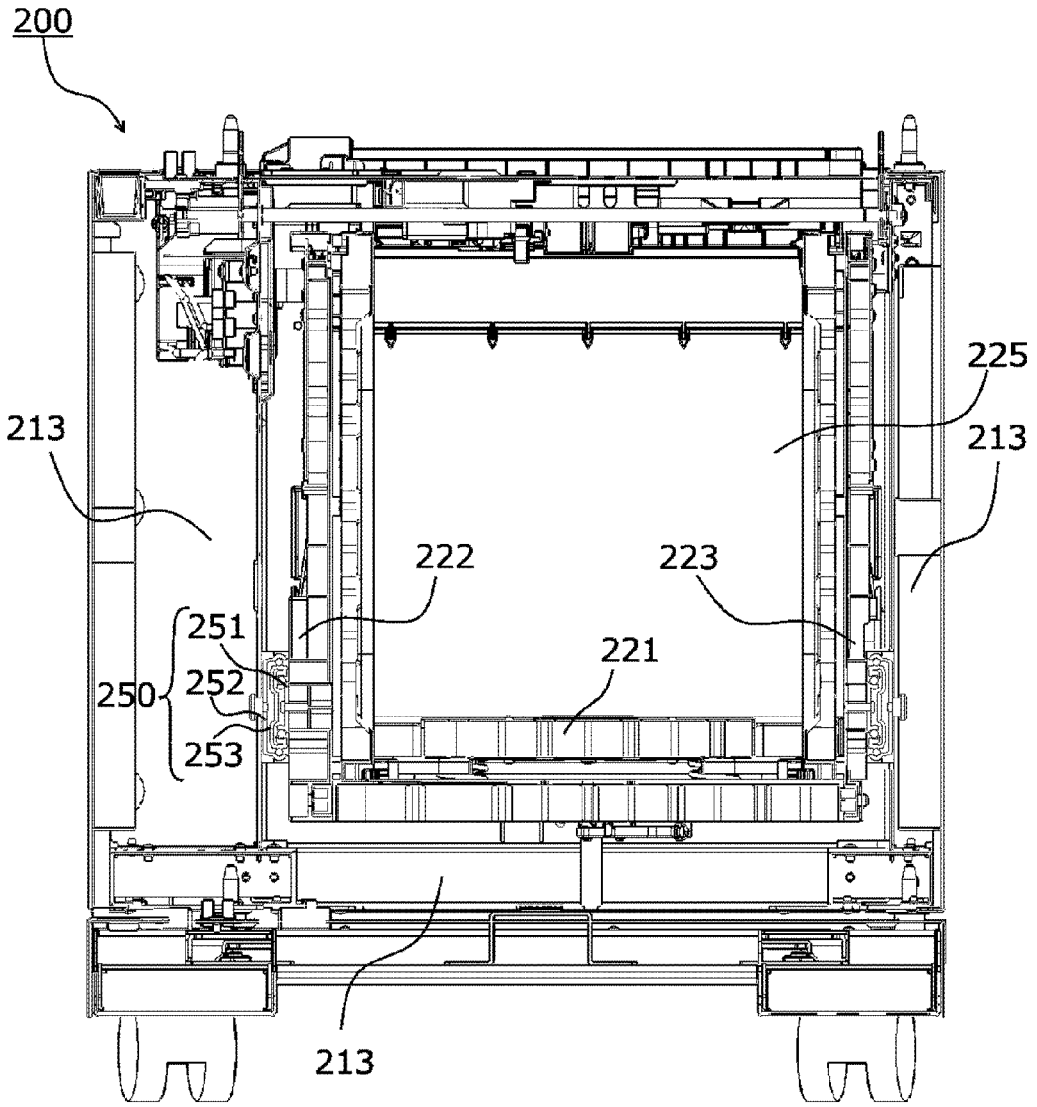
FIG. 3 is a vertical sectional view of the transport device.
Figure 4:
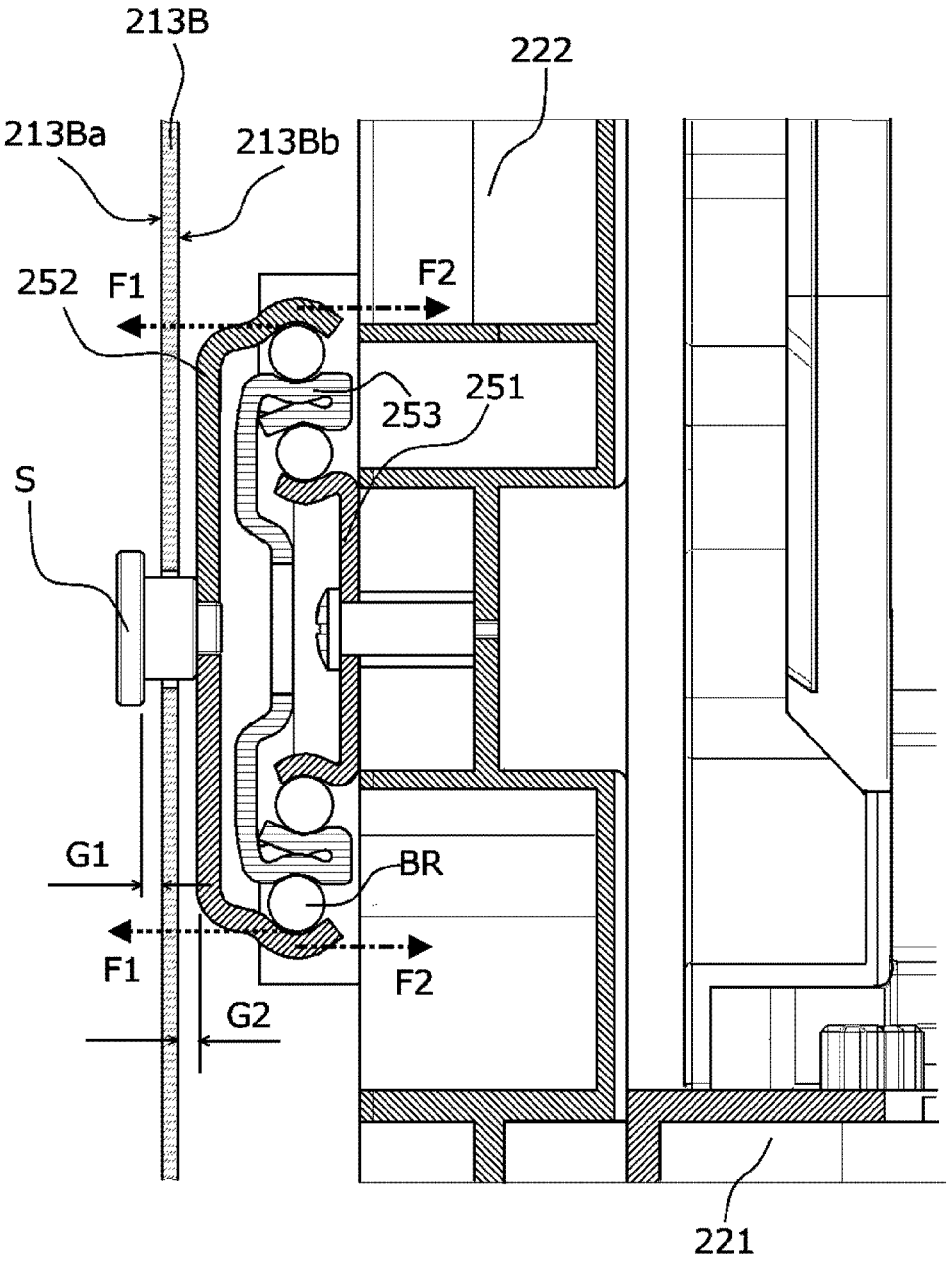
FIG. 4 is a vertical sectional schematic diagram illustrating apart of the transport device including a moving mechanism.
Figure 5A:
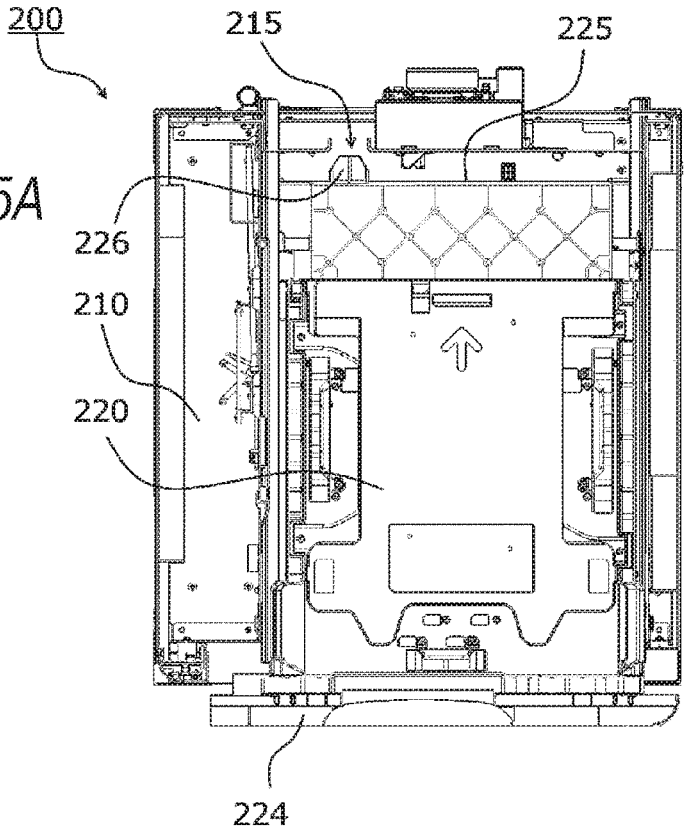
FIG. 5A is a plan view of the transport device in a state where an accommodating unit is partially pulled out.
Figure 5B:
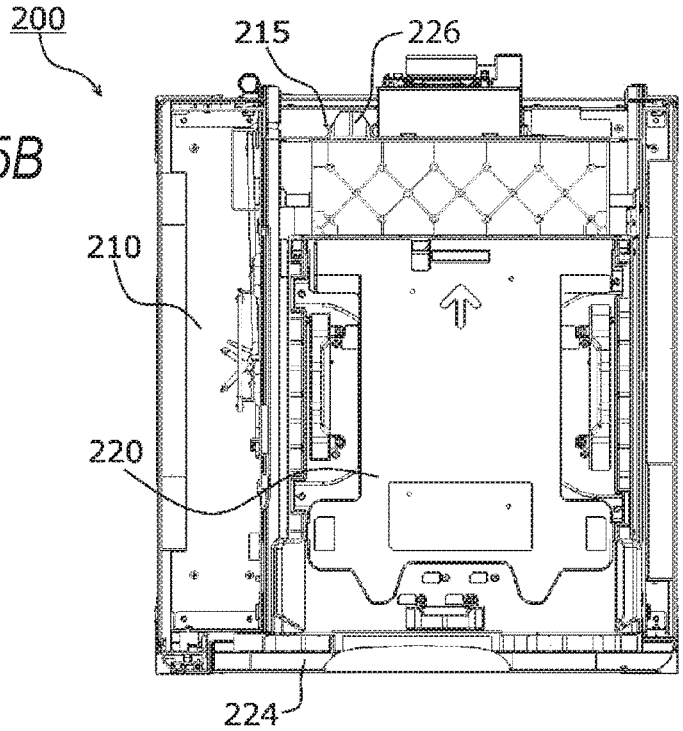
FIG. 5B is a plan view of the transport device in a state where the accommodating unit is mounted.
Figure 6A:
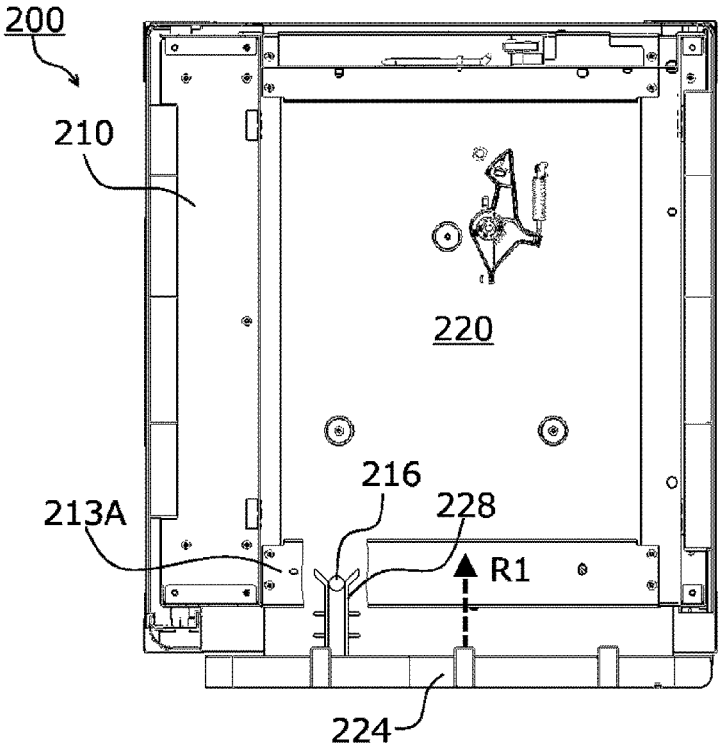
FIG. 6A is a bottom view of the transport device in a state where the accommodating unit is partially pulled out.
Figure 6B:
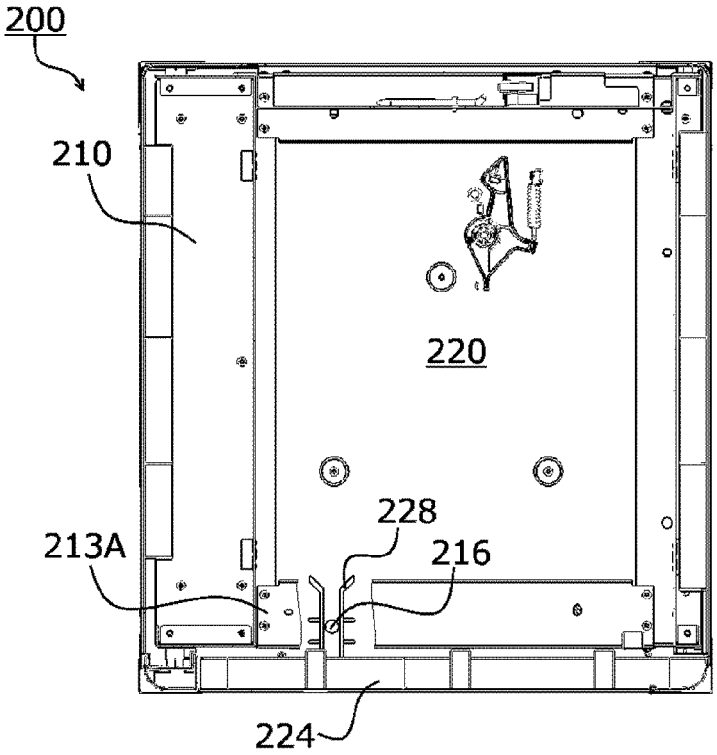
FIG. 6B is a bottom view of the transport device in a state where the accommodating unit is mounted.
Figure 7A:
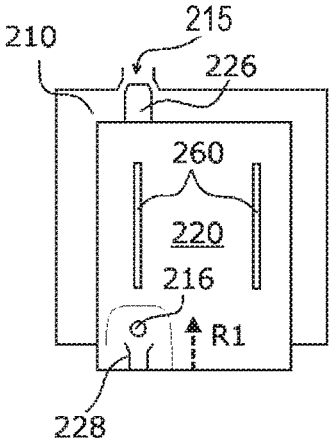
FIGS. 7A to 7C are plan schematic diagrams illustrating the positioning of the accommodating unit with respect to a body unit.
Figure 7B:
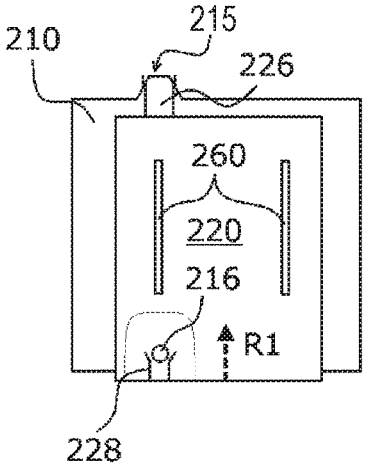
Figure 7C:
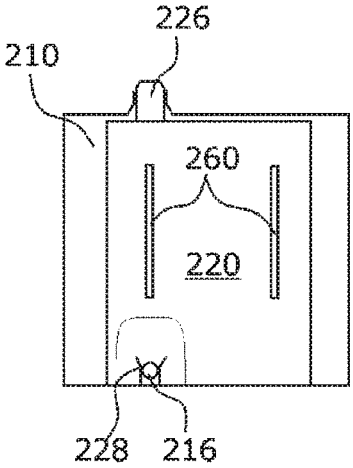

FIG. 2A is a perspective view illustrating the whole of the transport device 200, and FIG. 2B is a perspective view illustrating a state where the accommodating unit is pulled out, FIG. 3 is a vertical sectional view of the transport device 200, FIG. 4 is a vertical sectional view illustrating a part of the transport device 200 including a moving mechanism 250, FIG. 5A is a plan view of the transport device 200 in a state where the accommodating unit 220 is slightly pulled out, FIG. 5B is a plan view of the transport device 200 in a state where the accommodating unit 220 is mounted, FIG. 6A is a bottom view of the transport device 200 in a state where the accommodating unit 220 is slightly pulled out, and FIG. 6B is a bottom view of the transport device 200 in a state where the accommodating unit 220 is mounted, and FIGS. 7A to 7C are plan schematic diagrams illustrating positioning of the accommodating unit 220 with respect to the body unit 210.

Hereinafter, descriptions will be made on the configuration of the transport device 200 and the mounting operation of the accommodating unit 220 with reference to drawings.

(2.1) Overall Configuration

As illustrated in FIGS. 2A and 2B, the transport device 200 includes the body unit 210 and the accommodating unit 220 reciprocally held by the body unit 210.

In the body unit 210, the sheet feeding unit 230 (illustrated in FIG. 1) is provided within a metallic housing 213 (illustrated in FIG. 3) covered with synthetic resinous outer covers 211 and 212.

The accommodating unit 220 is a box-shape tray in its entirety which is entirely composed of a bottom plate 221, side plates 222 and 223, a front cover 224 and a back plate 225 which are made of a synthetic resin material (illustrated in FIG. 3), and is attached with the supply unit 240 (illustrated in FIG. 1).

As illustrated in FIG. 2B and FIG. 3, the accommodating unit 220 is supported to be reciprocal with respect to the body unit 210 by the moving mechanism 250.

The moving mechanism 250 is a rail mechanism composed of first rails 251 attached to the side plates 222 and 223 of the accommodating unit 220, second rails 252 assembled to the body unit 210 to be slidable with respect to the first rails, and intermediate rails 253 disposed to be slidable with respect to the second rails 252. The accommodating unit 220 is supported to be mounted or detached with respect to the body unit 210.

As illustrated in FIG. 4, the second rail 252 has a first gap G1 with an outer surface 213Ba of a body side plate 213B through a stud S with respect to the body side plate 213B erected from a bottom surface 213A of the housing 213 of the body unit 210, and a second gap G2 with an inner surface 213Bb of the body side plate 213B, and is movably held in the direction intersecting with (perpendicular to) the reciprocating direction of the accommodating unit 220.

The accommodating unit 220 includes a pair of guide members 260 configured to regulate a position in a width direction intersecting with (perpendicular to) the transport direction of the sheets P. The guide members 260 are provided to be movable in a direction intersecting with (perpendicular to) the transport direction of the sheets P according to the size of the sheets to be accommodated.

As illustrated in FIGS. 5A and 5B and FIGS. 7A to 7C, a positioning projection 226 is formed on the back plate 225 of the accommodating unit 220 to project toward the body unit 210, and a positioning hole 215 is provided in the body unit 210. The positioning projection 226 and the positioning hole 215 are fitted to each other to constitute a first positioning portion when the accommodating unit 220 is mounted in the body unit 210.

As illustrated in FIGS. 6A and 6B and FIGS. 7A to 7C, a positioning pin 216 projecting upward (Z direction) from the bottom surface 213A of the housing 213 is provided in the body unit 210, and a positioning guide 228 is formed on the bottom plate 221 of the accommodating unit 220. The positioning pin 216 and the positioning guide 228 are fitted to each other to constitute a second positioning portion when the accommodating unit 220 is mounted in the body unit 210.

The first positioning portion and the second positioning portion are provided to be spaced apart from each other at the front side and the rear side of the transport device 200, on the extension on which one of the pair of guide members 260 serving as a reference of a width direction of the sheet transport is provided.

In the first positioning portion and the second positioning portion configured as described above, as schematically illustrated in FIGS. 7A to 7C, when the accommodating unit 220 is mounted in the body unit 210, after the first positioning portion is positioned, the second positioning portion is positioned. Then, a variation of an operating force when the accommodating unit 220 is mounted in the body unit 210 may be reduced.

(2.2) Mounting Operation of Accommodating Unit

When the transport device 200 is replenished with sheets P as recording mediums, a handle portion 224*a* of the front cover 224 is operated to move the accommodating unit 220 from the body unit 210 in the direction of the arrow R2 (see FIG. 1) such that a sheet bundle is stacked on the sheet stacking plate BP in a state where the sheet stacking plate BP is exposed.

After the sheets Pare stacked on the sheet stacking plate BP, the handle portion 224*a* of the front cover 224 is operated so that the accommodating unit 220 is moved in the direction of the arrow R1 to be mounted in the body unit 210.

The accommodating unit 220 is a box-shape tray in its entirety which is entirely composed of the bottom plate 221, the side plates 222 and 223, the front cover 224 and the back plate 225 which are made of a synthetic resin material and is lighter as a whole as compared to one made of a metal. Meanwhile, according to the temperature condition of the use environment where the transport device 200 is provided, apart or the whole of the accommodating unit 220 may be more easily expanded or shrunk as compared to one made of a metal.

When the accommodating unit 220 is expanded, the moving mechanism 250 that reciprocally supports the accommodating unit 220 between the body unit 210 and the accommodating unit 220 may be pressed by the side plates 222 and 223 of the thermally expanded accommodating unit 220, and thus its operating force may be increased.

When the accommodating unit 220 is expanded or shrunk, the position of the accommodating unit 220 may be moved so that the position in the width direction intersecting with (perpendicular to) the transport direction of the stacked sheets P may be changed.

The accommodating unit 220 according to the present exemplary embodiment is supported to be reciprocal with respect to the body unit 210 by a rail mechanism composed of the first rails 251 attached to the side plates 222 and 223 of the accommodating unit 220, the second rails 252 assembled to the body unit 210 to be slidable with respect to the first rails, and the intermediate rails 253 disposed to be slidable with respect to the second rails 252.

The second rail 252 has the first gap G1 with the outer surface 213Ba of the body side plate 213B through the stud S with respect to the body side plate 213B of the body unit 210, and the second gap G2 with the inner surface 213Bb of the body side plate 213B.

When the synthetic resinous accommodating unit 220 is thermally expanded, the accommodating unit 220 is moved by the thermal expansion. The second rail 252 and the intermediate rail 253 press the second rail 252 toward the body side plate 213B of the body unit 210 through a ball BR (see the arrow F1 in FIG. 4). However, the movement of the accommodating unit 220 by the thermal expansion is absorbed by the second gap G2 provided between an outer surface 252*a* of the pressed second rail 252 and the inner surface 213Bb of the body side plate 213B.

When the synthetic resinous accommodating unit 220 is shrunk, the accommodating unit 220 is moved by the shrinkage. The second rail 252 and the intermediate rail 253 act to draw the second rail 252 from the body side plate 213B of the body unit 210 to the inside through the ball BR (see the arrow F2 in FIG. 4). However, the movement of the accommodating unit 220 by the shrinkage is absorbed by the first gap G1 between the outer surface 213Ba of the body side plate 213B and the stud S.

Thus, even when the accommodating unit 220 is thermally expanded or shrunk, the operating force when the accommodating unit 220 is mounted in or detached from the body unit 210 is suppressed from being increased.

In the transport device 200 according to the present exemplary embodiment, the first positioning portion and the second positioning portion are provided to be spaced apart from each other at the front side and the rear side of the transport device 200, on the extension on which one of the pair of guide members 260 serving as a reference of a width direction of the sheet transport is provided. Thus, even when the accommodating unit 220 is expanded or shrunk, a position variation in one of the guide members 260 with respect to the body unit 210 is suppressed, and a position variation in the width direction of the transported sheet P is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a body unit;

an accommodating unit configured to accommodate a recording medium, wherein the accommodating unit is mounted to be reciprocal with respect to the body unit;

a pair of guide members configured to contact end portions of the recording medium to position the recording medium, wherein each one or the pair of guide members extends along an axis parallel to a transport direction of the recording medium;

a first rail that is attached to the accommodating unit and, wherein the first rail is configured to guide reciprocation of the accommodating unit;

a second rail that is attached to the body unit, wherein the second rail is configured to be movable in a direction, which intersects with a reciprocation direction of the accommodating unit, the second rail being assembled to the body unit to be slidable with respect to the first rail; and a first positioning portion and a second positioning portion configured to guide the accommodating unit, in the reciprocation direction of the accommodating unit with respect to the body unit, to be engaged with the body unit.

2. The transport device according to claim 1, wherein:

the accommodating unit is positioned with respect to the body unit in the reciprocation direction, and the first positioning portion and the second positioning portion lie along the axis of one of the pair of guide members.

3. The transport device according to claim 1, wherein:

the first positioning portion configured to position the accommodating unit at a rear side, in the reciprocation direction, of the body unit, and the second positioning portion configured to position the accommodating unit at a position spaced apart from the first positioning portion in the reciprocation direction, and wherein the transport device is configured such that, when the accommodating unit is mounted in the body unit, the second positioning portion is positioned after the first positioning portion is positioned.

4. The transport device according to claim 3, wherein the first positioning portion includes:

a positioning projection formed on the accommodating unit, and a positioning hole configured to allow the body unit to be engageable and disengageable with the positioning projection in the reciprocation direction of the accommodating unit, and the second positioning portion includes:

a positioning pin provided in the body unit, and a positioning guide configured to allow the accommodating unit to be fitted to and guided by the positioning pin in the reciprocation direction of the accommodating unit.

5. The transport device according to claim 4, wherein the accommodating unit is made of a synthetic resin.

6. The transport device according to claim 3, wherein the accommodating unit is made of a synthetic resin.

7. The transport device according to claim 2, wherein the accommodating unit is made of a synthetic resin.

8. The transport device according to claim 1, wherein the accommodating unit is made of a synthetic resin.

9. The transport device according to claim 1, wherein the accommodating unit comprises a synthetic resin material, and the second rail is configured to be moveable in the direction, which intersects with the reciprocation direction of the accommodating unit, to absorb a movement of the accommodating unit when the accommodating unit is expanded or shrunk.

10. The transport device according to claim 9, wherein the second rail is configured to be moveable in the direction to absorb a movement of the accommodating unit when the accommodating unit is thermally expanded or thermally shrunk.

11. The transport device according to claim 1, wherein the second rail is configured to be moveable in the direction, which intersects with the reciprocation direction of the accommodating unit, to absorb a movement of the accommodating unit when the accommodating unit is thermally expanded or thermally shrunk.

12. The transport device according to claim 1, wherein the pair of guide members are configured to be moveable in the width direction intersecting with a transport direction of the recording medium.

13. The transport device according to claim 1, further comprising a first positioning portion and a second positioning portion, being respectively positioned at a rear side of the body unit and a front side of the body unit, wherein the first positioning portion and the second positioning portion are configured to guide the accommodating unit in the reciprocation direction of the accommodating unit with respect to the body unit, to be engaged with the body unit.

14. The transport device according to claim 13, wherein the first positioning portion and the second positioning portion are configured to guide the accommodating unit, in a direction which intersects with the reciprocation direction of the accommodating unit, to be engaged with the body unit.

15. The transport device according to claim 1, wherein the pair of guide members are further configured to move orthogonal to the transport direction of the recording medium.

16. The transport device according to claim 1, wherein the pair of guide members are further configured to be moveable in a width direction of the recording medium to contact the end portions of the recording medium.

* * * * *